US005601416A

United States Patent [19]

Murakami et al.

[11] Patent Number: 5,601,416

[45] Date of Patent: Feb. 11, 1997

[54] WAVE CAM TYPE COMPRESSOR

[75] Inventors: Kazuo Murakami; Toshiro Fujii; Kazuaki Iwama, all of Kariya, Japan

[73] Assignee: Kabushiki Kaisha Toyoda Jidoshokki Seisakusho, Kariya, Japan

[21] Appl. No.: 475,043

[22] Filed: Jun. 7, 1995

Related U.S. Application Data

[63] Continuation-in-part of Ser. No. 363,609, Dec. 23, 1994, which is a continuation-in-part of Ser. No. 254,970, Jun. 7, 1994, abandoned.

[30] Foreign Application Priority Data

Jun. 28, 1994 [JP] Japan ..... 6-146746

[51] Int. Cl.[6] ..... F04B 1/12

[52] U.S. Cl. ..... 417/269; 92/71; 74/56

[58] Field of Search ..... 417/269; 92/71; 74/567, 569, 55, 56

[56] References Cited

U.S. PATENT DOCUMENTS 2,176,300 12/1937 Fette .
4,756,239 7/1988 Hattori et al. .
5,452,647 9/1995 Murakami et al. ..... 92/71

FOREIGN PATENT DOCUMENTS 3022190 8/1982 Germany ..... 417/269
57-51977 3/1982 Japan ..... 417/269

*Primary Examiner*—Charles G. Freay
*Attorney, Agent, or Firm*—Brooks Haidt Haffner & Delahunty

[57] ABSTRACT

A wave cam type compressor is described. Cylindroid blocks are provided to support a drive shaft and to contain a plurality of cylinder bores centered around the drive shaft. A wave cam attached to the drive shaft has cam surfaces on the front side and the rear side. The cam surfaces are composed of convex surfaces only. Pistons in the cylindroid blocks are operated by the wave cam through shoes. Each shoe has a spherical surface and a flat surface. The spherical surface is fitted in a recess formed on the piston, while the flat surface makes line contact with the cam surface of the wave cam. The shoes move relative to the wave cam on a predetermined circular path on the cam surfaces. The rotation of the wave cam together with the drive shaft is converted to reciprocating motions of the pistons in the cylinder bores with the aid of the shoes and wave cam, thus achieving compression of a fluid supplied to the cylinder bores.

18 Claims, 9 Drawing Sheets

WAVE CAM TYPE COMPRESSOR

BACKGROUND OF THE INVENTION

This application is a continuation-in-part application of the copending U.S. patent application Ser. No. 08/363,609 filed on Dec. 23, 1994 which is a continuation-in-part application of U.S. patent application Ser. No. 08/254,970, filed on Jun. 7, 1994, now abandoned in favor of continuation application, Ser. No. 08/645,929, filed on May 14, 1996 which is incorporated herein by reference.

FIELD OF THE INVENTION

The present invention relates generally to a compressor for compressing a fluid supplied to cylinder bores by reciprocating pistons in the associated cylinder bores. More particularly, the present invention relates to a wave cam type compressor in which the pistons are adapted to be reciprocated by rotating a wave cam mounted on a drive shaft.

DESCRIPTION OF THE RELATED ART

Prior art wave cam type compressors are each provided with a drive shaft, a wave cam attached to the drive shaft and pistons connected to the wave cam and incorporated in cylinder bores respectively. In this type of compressor, a fluid supplied to the cylinder bores is compressed by rotating the wave cam by the drive shaft to reciprocate the pistons in the cylinder bores. One example of such a wave cam type compressor is disclosed in Japanese Unexamined Patent Publication No. Show 57-110783, in which a roller is interposed between each cam surface and each double-headed piston. These rollers roll relative to the wave cam to transmit cyclic displacement of the cam surfaces to the piston. The cyclic displacement of the cam surface is caused by the rotation of the wave cam. The transmission of cam displacement causes the piston to reciprocate depending on the characteristics of the cam surface.

Also, there is a swash plate type compressor employing a swash plate in place of the wave cam. In this type of compressor, the swash plate is rotated by a drive shaft to reciprocate pistons in cylinder bores, and thus a fluid supplied to the cylinder bores is compressed. In this type of compressor, the cyclic displacement of the swash plate can be expressed by a curve characteristic of a sine wave. In this compressor, compression is performed only once by one head of each double-headed piston per rotation of the drive shaft. On the other hand, in the compressor employing a wave cam, compression is performed twice by one head of the double-headed piston per rotation of the drive shaft due to the shape of the cam surfaces of the wave cam.

Suppose that there are coordinates x, y and z which intersect orthogonally to one another in a wave cam 60, as shown in FIG. 15. Cam surfaces 60*a*, 60*b* of the wave cam 60 consist of solid curved surfaces expressed by the following equation (1):

$$z=f(x,y) \tag{1}$$

The above equation (1) means that the axial displacement of a point following one of the cam surfaces 60*a*, 60*b* changes depending not only on the coordinate x but also on the coordinate y. The coordinate z represents the axis of the drive shaft. The coordinate x represents an axis which is orthogonal to the drive shaft and passes through diametrically opposed sites on the cam surface associated with the top dead center of the piston stroke. The coordinate y represents an axis which is orthogonal to the drive shaft and passes diametrically opposed sites on the cam surface associated with the bottom dead center of the piston stroke.

Generally, the wave cam described above must be molded to have wavy surfaces curving in the circumferential direction. Accordingly, intricate die cast molding must be employed. Further, in order to form such complicated cam surfaces, a plurality of end mills having different shapes must be employed in the grinding step, which requires extended grinding time. In addition, due to the necessity of transmitting displacement of the cam surfaces with the rollers to the pistons to move the pistons smoothly, the wavy cam surface must be subjected to high accuracy polishing using a grindstone and the like. However, the wavy cam surfaces have solid curved surfaces consisting of crests and troughs so as to achieve plus-minus phase conversion. Accordingly, the circumferential length of the cam surface is designed to be longer toward the outside. This means that it is difficult to polish the cam surface at a constant degree of accuracy in the radial direction, because different degrees of polishing are required depending on the site. Further, such a way of polishing makes it difficult to avoid biased abrasion of the grindstone which would, in turn, lead to roughness of the cam surface and reduction in shape accuracy.

Japanese Unexamined Patent Publication No. Show 62-121875 discloses that the above-described problems can be solved by subjecting the wave cam to fine finishing using a grindstone of the same shape as the roller. The grindstone has a conical shape such that the relative contact rate at every point in the circumferential direction of the wave cam may be constant. Accordingly, the grindstone is prevented from undergoing biased abrasion, and fine finishing of the wave cam is achieved. However, since the grindstone disclosed in the above patent publication has a special form, i.e., a conical form unlike the existing grindstones, it gives rise to the extra costs of molding the grindstone. Further, the wave cams to which a conical grindstone can be applied are limited depending on the inclination angle of the cone.

Moreover, since the grindstone has a special shape, a considerable degree of accuracy is required in inspecting the shape of the grindstone after dressing.

SUMMARY OF THE INVENTION

Accordingly, it is a primary objective of the present invention to provide a wave cam type compressor which can facilitate machining of the cam surface of the wave cam and can improve machining accuracy by reducing variation in the machining resistance on the cam surface.

To achieve the foregoing and other objects and in accordance with the purpose of the present invention, a wave cam type compressor is provided. The compressor has a wave cam body mounted on a drive shaft for integral rotation and a piston operably connected to the cam body. The rotation of the drive shaft is converted into a reciprocating movement of the piston between a top dead center and a bottom dead center in a cylinder bore to compress fluid supplied to the cylinder bore. The cam body has a cam surface for driving the piston. The compressor has a shoe interposed between the cam surface and the piston. The shoe is arranged to follow a predetermined path on the cam surface. The cam surface has a profile which matches a locus of a predetermined curve and forms a convex surface matching a part of an imaginary cylindroid.

BRIEF DESCRIPTION OF THE DRAWINGS

The features of the present invention that are believed to be novel are set forth with particularity in the appended claims. The invention, together with the objects and advantages thereof, may best be understood by reference to the following description of the presently preferred embodiments taken in conjunction with the accompanying drawings in which:

DETAILED DESCRIPTION OF THE PREFERRED EMBODIMENTS

A first embodiment of the wave cam type compressor according to the present invention will be detailed below.

Figure 1:
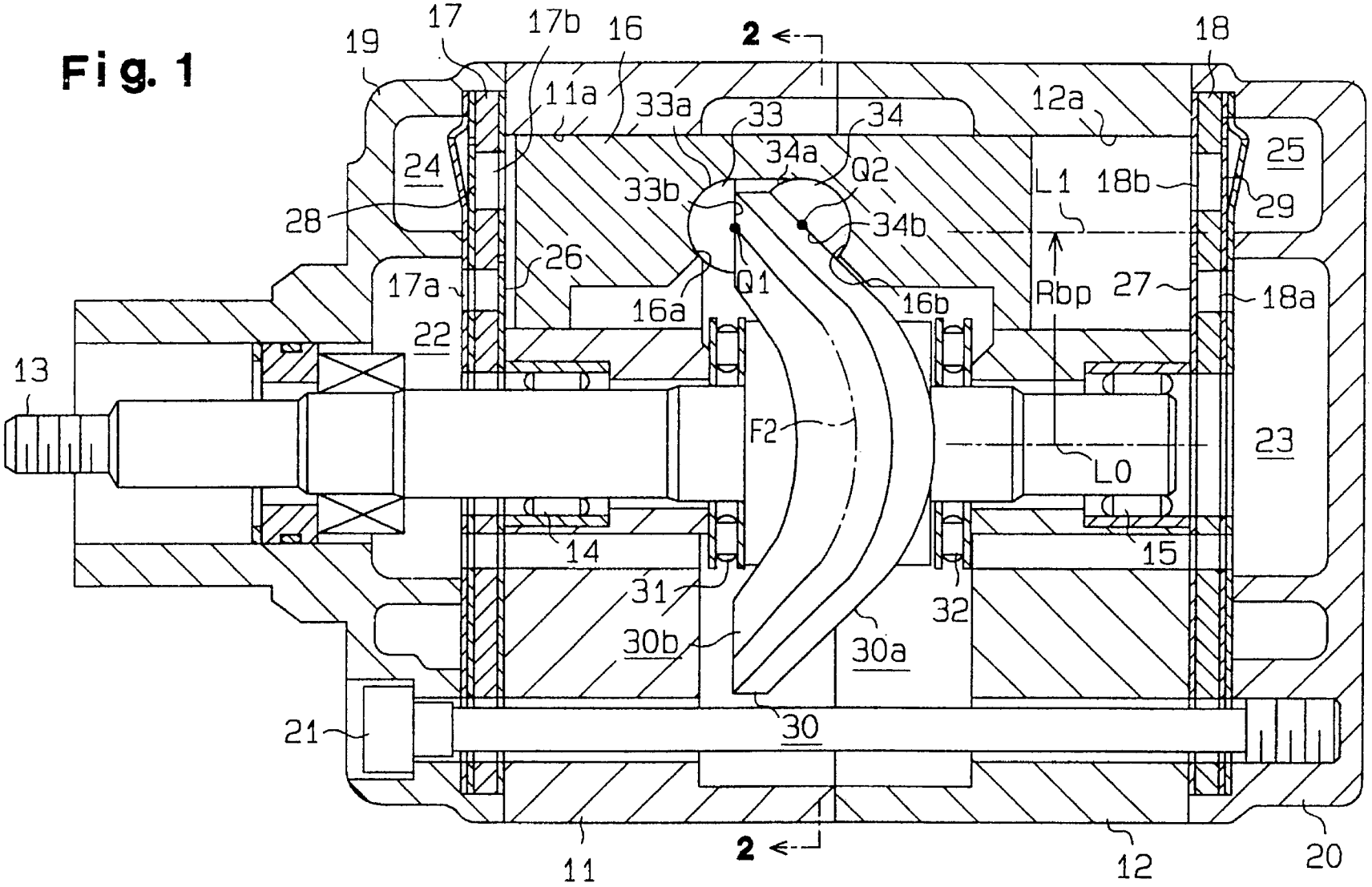
FIG. 1 is a cross sectional side elevation view of a wave cam type compressor according to a first embodiment of the invention.

As shown in FIG. 1, a pair of cylindrical blocks 11, 12, which are combined and fastened to each other, rotatably support a drive shaft 13 through a pair of radial bearings 14, 15. A plurality of cylinder bores 11*a*, 12*a* are formed in these blocks 11, 12, and a front bore 11*a* and a rear bore 12*a* form a coaxial pair. Pairs of cylinder bores 11*a*, 12*a* are defined at equiangular intervals about the drive shaft 13. A reciprocating double-headed piston 16 is fitted into each pair of cylinder bores 11*a*, 12*a*.

A front housing 19 and a rear housing 20 are attached to the front end of the cylindrical block 11 and the rear end of the cylindrical block 12, respectively. These housings 19, 20 are fastened to the blocks 11, 12 by a plurality of bolts 21 such that the blocks 11, 12 are closed. Suction chambers 22, 23 are defined in the housings 19, 20, respectively. These chambers 22, 23 communicate with the cylinder bores 11*a*, 12*a* via suction ports 17*a*, 18*a* defined in the valve plates 17, 18, respectively. Discharge chambers 24, 25 are also defined in the housings 19, 20, respectively. These discharge chambers 24, 25 are separated from the suction chambers 22, 23 and communicate with the cylinder bores 11*a*, 12*a* via discharge ports 17*b*, 18*b* defined in the valve plates 17, 18, respectively. Suction valves 26, 27 are applied to the suction ports 17*a*, 18*a*, and flex open to allow the cylinder bores 11*a*, 12*a* to communicate with the suction chambers 22, 23, respectively. Discharge valves 28, 29 applied to the discharge ports 17*b*, 18*b* also flex open to allow the cylinder bores 11*a*, 12*a* to communicate with the discharge chambers 24, 25, respectively.

A wave cam 30 is fitted on the drive shaft 13. Thrust bearings 31, 32 interposed between the wave cam 30 and each cylindrical block 11, 12. The thrust bearings 31, 32 receive thrust loads applied to the drive shaft 13. Hemispherical shoes 33, 34 interposed between the wave cam 30 and each piston 16, have spherical surfaces 33*a*, 34*a* and flat surfaces 33*b*, 34*b*, respectively, The spherical surfaces 33*a*, 34*a* are fitted, respectively, in recesses 16*a*, 16*b* defined in each piston 16. The flat surfaces 33*b*, 34*b* make sliding contact with the cam surfaces 30*a*, 30*b* of the wave cam 30, respectively. The centers Q1, Q2 of the spherical surfaces 33*a*, 34*a* are aligned with the centers of the flat surfaces 33*b*, 34*b*, respectively. The spherical surfaces 33*a*, 34*a* of the shoes 33, 34 are fitted in the recesses 16*a*, 16*b* of each piston 16 to restrict movement of the shoes 33, 34.

Figure 2:
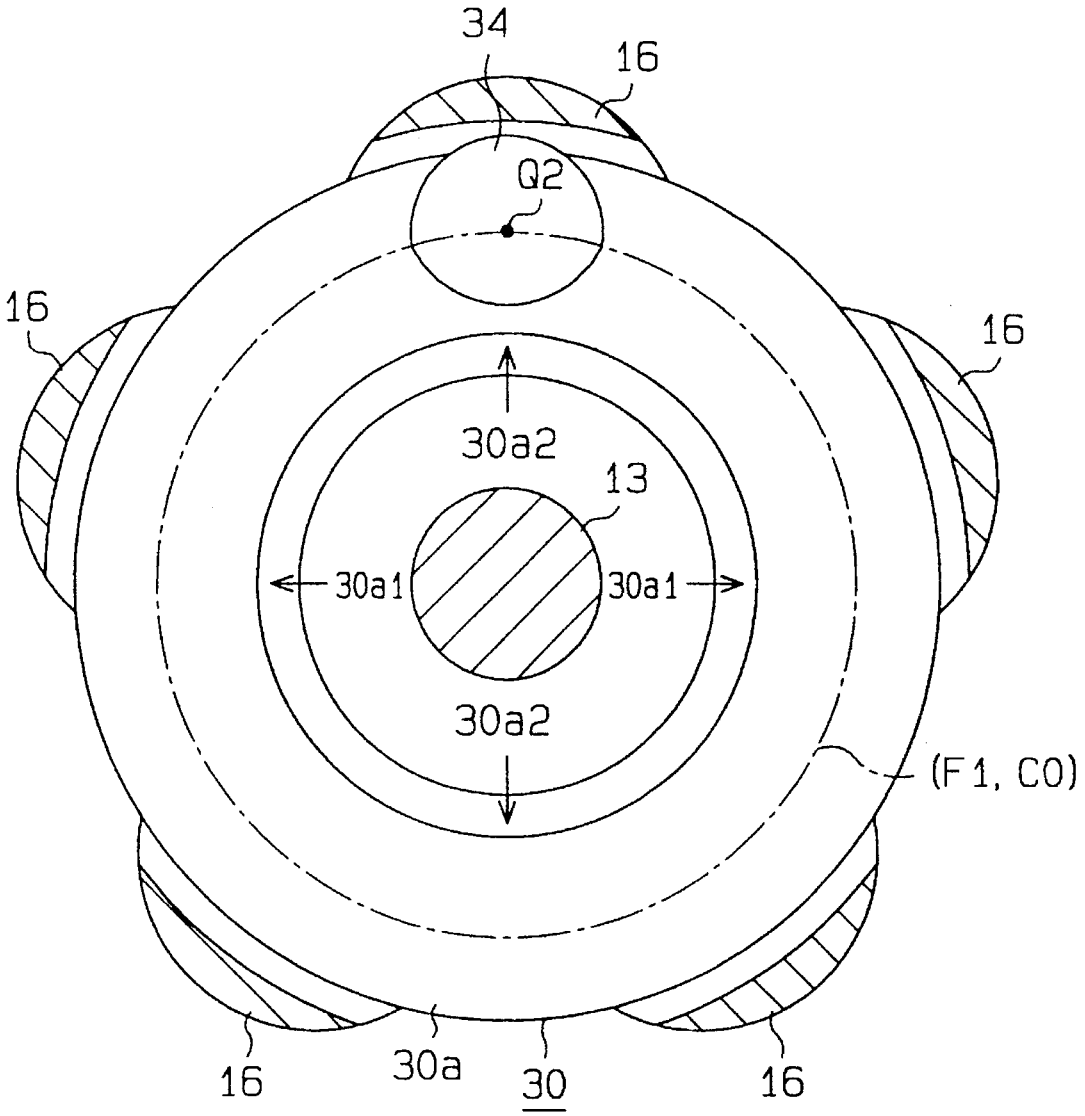
FIG. 2 shows a cross-sectional view of the wave cam taken along the line 2—2 of FIG. 1.

As shown in FIGS. 1 and 2, the rear cam surface 30*a* and the front cam surface 30*b* of the wave cam 30 each have an imaginary circular path CO representing the locus of the points of intersection between the cam surfaces and the axes L1 of the cylinder bores 11*a*, 12*a*. This imaginary circular path CO has repeating cyclic displacement characteristics in the axial direction L1 of the cylinder bores 11*a*, 12*a*. These displacement characteristics can be expressed by the displacement curves P1, F2 as the cyclic loci on the cam surfaces 30*a*, 30*b*, in FIGS. 1 to 3 and FIGS. 5 to 8. The center of the imaginary cylindrical surface CO coincides with the axis LO of the drive shaft 13. The centers Q1, Q2 of the spherical surfaces 33*a*, 34*a* continually contact the cam surfaces 30*a*, 30*b* along the displacement curves P1, F2, respectively.

Thus, the displacement in the reciprocal motion of each piston 16, when the piston 16 reciprocates in the cylinder bores 11*a*, 12*a* under rotation of the wave cam 30, corresponds to that of the displacement curves P1, F2.

Figure 3:
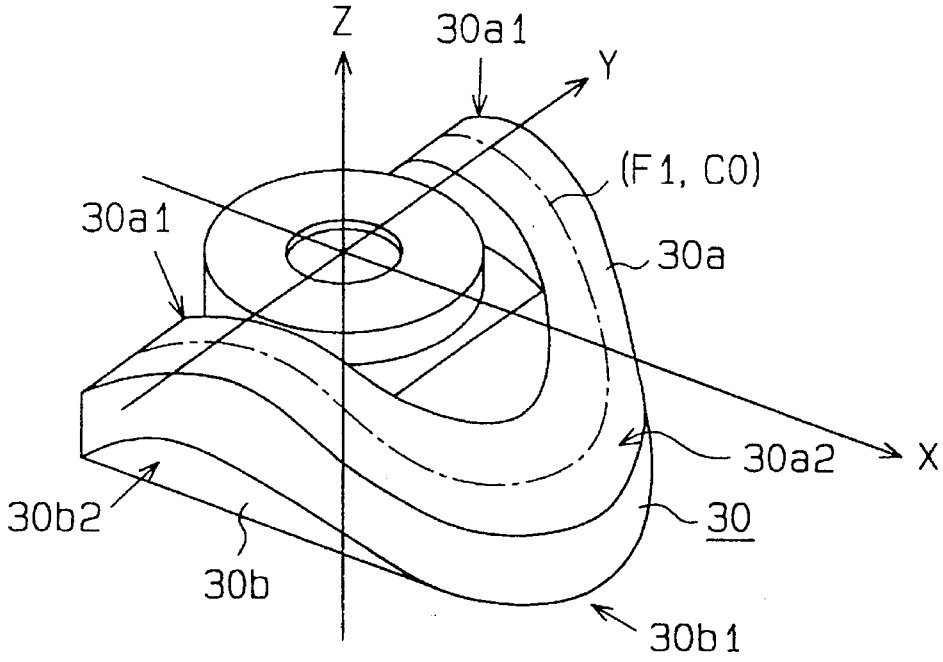
FIG. 3 shows in perspective view the wave cam consisting of predetermined curved surfaces.

As shown in FIG. 3, the cam surfaces 30*a*, 30*b* of the wave cam 30 consist of predetermined arched surfaces (hereinafter simply referred to as "arched surfaces"). Suppose that one arched surface of the wave cam 30 is cut in a direction connecting two first diametrically opposed high sites 30*a*1 on the cam surface 30*a* associated with the top dead center of stroke of the piston 16 in the cylinder bores 11*a*, 12*a*. Also, suppose that the opposite surface of the wave cam 30 is cut in a second direction connecting two diametrically opposed high sites 30*b*1 on the other cam surface 30*b*. Each surface corresponds to a curved surface which has the same profile (contour) as that of an arched director curve. A director curve is a predetermined curve along which a straight line is moved to generate a curved surface. Now, provided that a z-axis corresponds to the rotation axis LO, and that an orthogonal x-axis is defined in the direction of a line connecting the low sites and 30*a*2, the above-described arched surface can be expressed by the following equation (2):

$$z=f(x) \tag{2}$$

As the equation (2) clearly shows, the number of parameters to be taken into consideration with respect to this arched surface is smaller than that to be taken into consideration with respect to the solid curved surfaces expressed by the equation (1) referred to the prior art wave cam 60. Accordingly, the wave cam 30 according to this embodiment can be produced more easily due to the reduced number of parameters to be taken into consideration.

Figure 4:
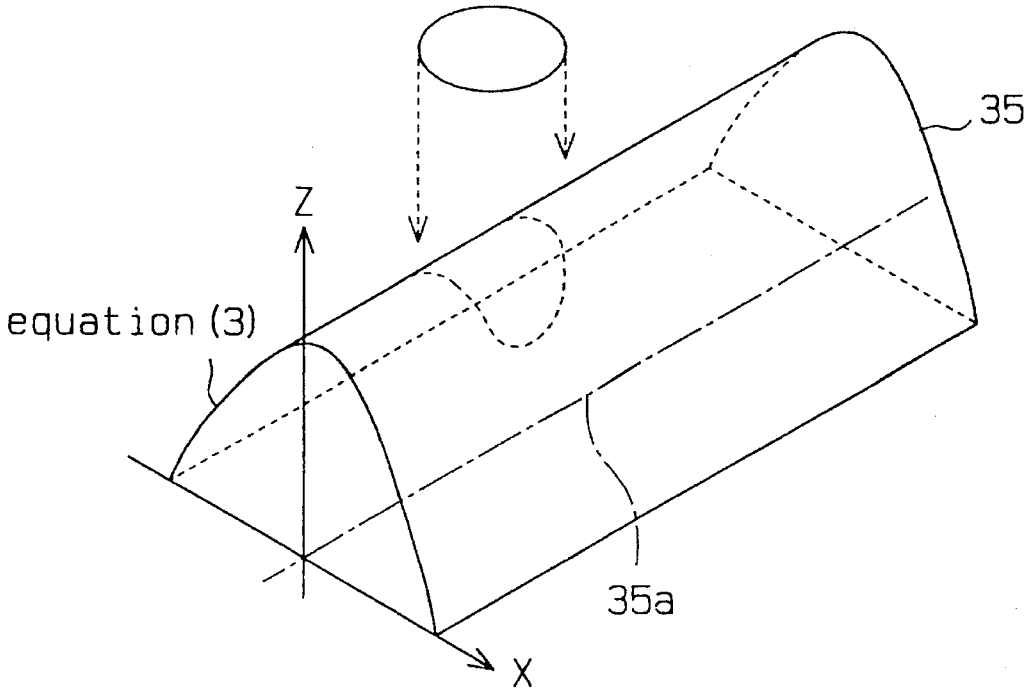
FIG. 4 shows generally a perspective view of a predetermined parabolic cylindroid.

As shown in FIG. 4, the curved surfaces on the cam surfaces 30*a*, 30*b* of the wave cam 30 in this embodiment can be obtained by cutting, along a circle, the surface of a parabolic cylinder 35 having, as a director curve, a parabola as shown by the following equation (3) drawn based on the parameters x and z:

$$z=-C1(x^2)+C2 \tag{3}$$

C1 and C2 are constants. The wave cam 30 according to this embodiment is obtained by combining two of such curved surfaces back to back.

Thus, as shown in FIG. 3, each of two low sites 30*a*2, and two low sites 30*b*2 as well as each of two high sites 30*a*1 on the cam surface 30*a* and two high sites 30*b*1 on the cam surface 30*b* are separated by an angular interval of 180°. The first high site 30*a*1 and the first low site 30*a*2 on the cam surface 30*a*, are separated by an angular interval of 90°, as are sites 30*b*1 and 30*b*2 on the cam surface 30*b*. The low site 30*a*2 on cam surface 30*a* and the high site 30*b*1 on the opposite cam surface 30*b* are back to back; whereas the high site 30*a*1 on cam surface 30*a* and the low site 30*b*2 on the opposite cam surface 30*b* are back to back. The low sites 30*a*2, 30*b*2 are sites associated with the bottom dead center of stroke of the piston 16 in the cylinder bores 11*a*, 12*a*; whereas the high sites 30*a*1, 30*b*1 are sites associated with the top dead center of the piston stroke. Both the cam surface 30*a* and the opposite surface 30*b* are convex. The cam surface 30*a* and the cam surface 30*b* are arranged such that there is a phase difference of 90° therebetween.

The interval between the centers Q1, Q2 of the spherical surfaces 33*a*, 34*a* of the shoes 33, 34 should be constant so that each piston 16 can reciprocate smoothly. In other words, it is necessary that the distance between the displacement curves F1, F2 on the cam surfaces 30*a*, 30*b* be constant in the axial direction LO. In order to satisfy this requirement, the following two conditions must be established:

The first condition is that the cam surfaces 30*a*,30*b* of the wave cam 30 are of the same profile. The second condition is that the parabolas forming the cam profiles are symmetrical.

It should be noted here that the first condition can be established by incorporating the profile obtained by cutting, along a circle, the surface of a parabolic cylindroid 35, as described above. The second condition can be satisfied, if the cam surfaces 30*a*,30*b* can be expressed by a curve characteristic of a sine wave. In the case of this embodiment, provided that the rotation angle of the wave cam 30 is θ and the stroke of the piston 16 is H, the relationship between the displacement of the centers Q1,Q2 of the shoes 33,34 and the rotation angle θ can be expressed by the following equation (4):

$$z(\theta)=(H/2)\cos(2\theta) \tag{4}$$

Since the cam surfaces 30*a*,30*b* of the wave cam 30 are of the same profile in this embodiment, only one cam surface 30*a* will be discussed. The rotation angle θ of the wave cam 30 when the piston 16 is at the top dead center is defined as 0°; the axis z corresponds to the axis L0 of the drive shaft 13; the axis y is parallel to the axis 35*a* of the parabolic cylindroid 35 constituting the cam surface 30*a*; and the axis x is parallel to the axis 35*a* of the parabolic cylindroid 35 constituting the cam surface 30*b*.

Figure 5:
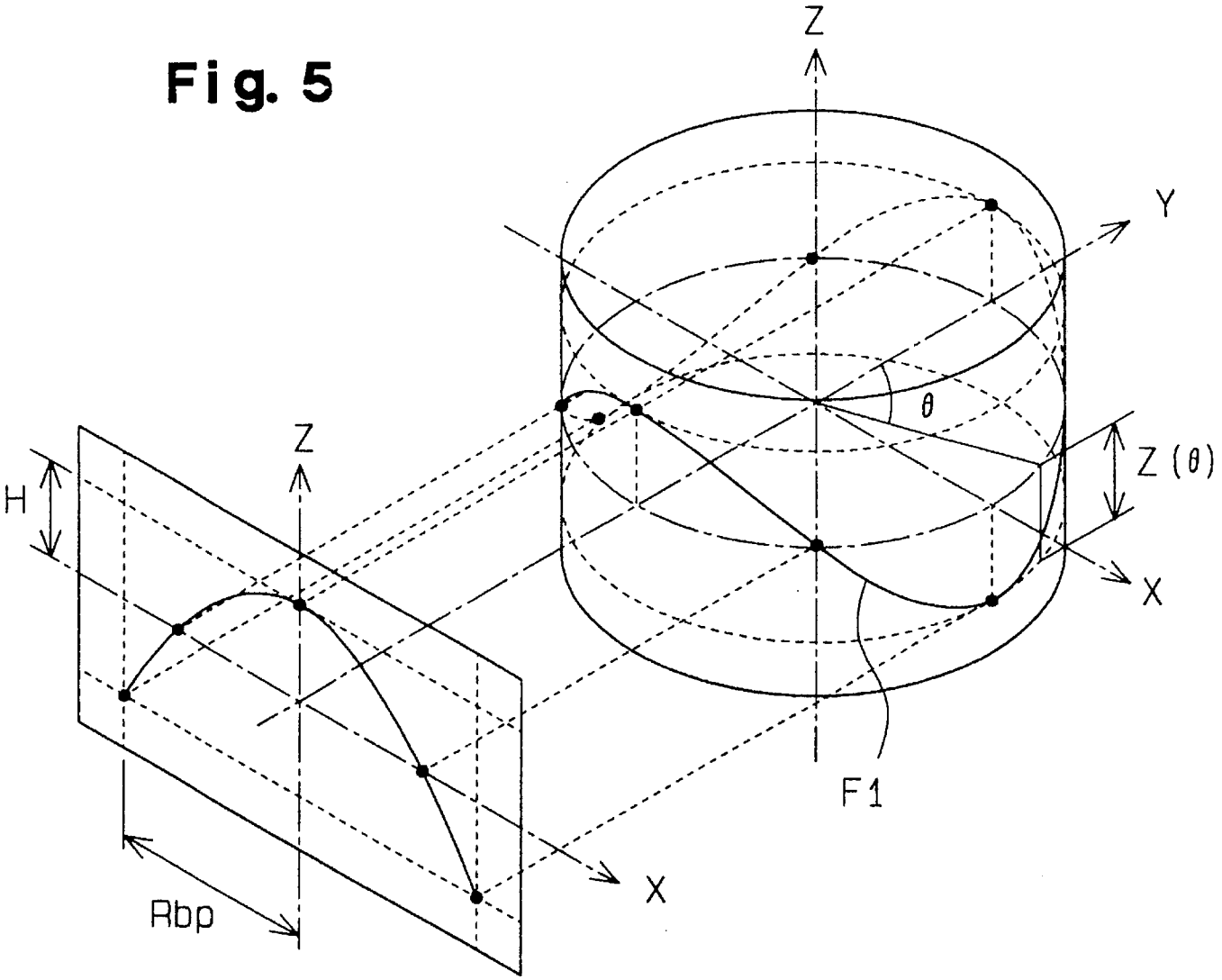
FIG. 5 shows generally a diagrammatic view of the displacement curve (cyclic orbit) as displacement characteristics of the cam surface.

As shown in FIG. 5, when the above equation (4) is projected onto an x–z plane, the coordinate x of z(θ) can be expressed by the following equation (5):

$$x(\theta)=(Rbp)\ (\sin\theta) \tag{5}$$

wherein Rbp represents the radius of the curve co. From the equations (4) and (5), the relationship between the coordinate z and the coordinate x can be expressed by the following equation (6):

$$\begin{aligned} z(\theta) &= (H/2)\cos(2\theta) \\ &= (H/2)(1-2\sin^2\theta) \\ \therefore\ z(x) &= (H/2)(1-x^2/Rbp^2) \\ &= H/2-H(x^2)/(2\,Rbp^2) \end{aligned} \tag{6}$$

The equation (6) represents a parabola, and the following equation (7) can be derived from the equations (2) and (6):

$$C1=H/(2Rbp^2)$$

$$C2=H/2 \tag{7}$$

Namely, the piston 16 can be reciprocated smoothly by employing a profile obtained by cutting, along a circle, the surface of the parabolic cylindroid 35 having as the director curve a parabola satisfying the above equation (7).

The operation of the thus described wave cam type compressor will now be described. When the wave cam 30 is rotated by the drive shaft 13, each piston 16 is reciprocated in the cylinder bores 11*a*,12*a* by the shoes 33,34 in accordance with the cam action. In the suction stroke, where the piston 16 in the cylinder bores 11*a*,12*a* retracts from the top dead center to the bottom dead center, a refrigerant gas in the suction chambers 22,23 is taken into the cylinder bores 11*a*,12*a* through the suction ports 17*a*,18*a* thrusting the suction valves 26,27 aside. Likewise, in the compression stroke, where the piston 16 in the cylinder bores 11*a*,12*a* moves from the bottom dead center to the top dead center, the refrigerant gas in the cylinder bores 11*a*,12*a* is compressed to a predetermined pressure level. Upon reaching the predetermined pressure level, the refrigerant gas is discharged through the discharge ports 17*b*,18*b* into the discharge chambers 24,25, pushing the discharge valves 28,29 aside.

Figure 6:
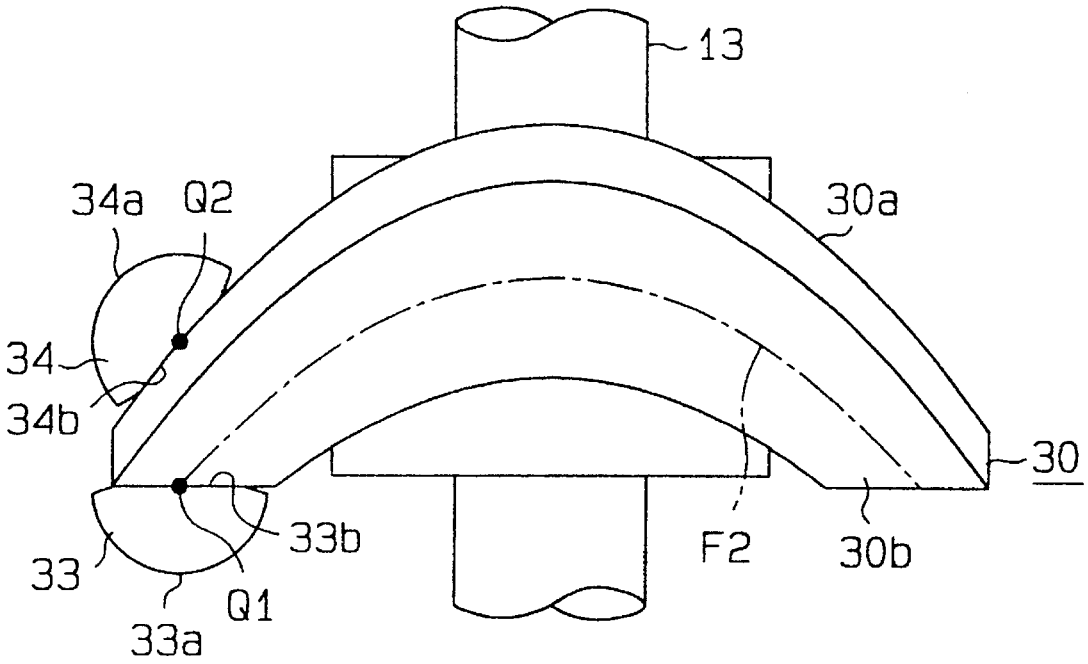
FIG. 6 shows a plan view of the wave cam consisting of predetermined curved surfaces.
Figure 7:
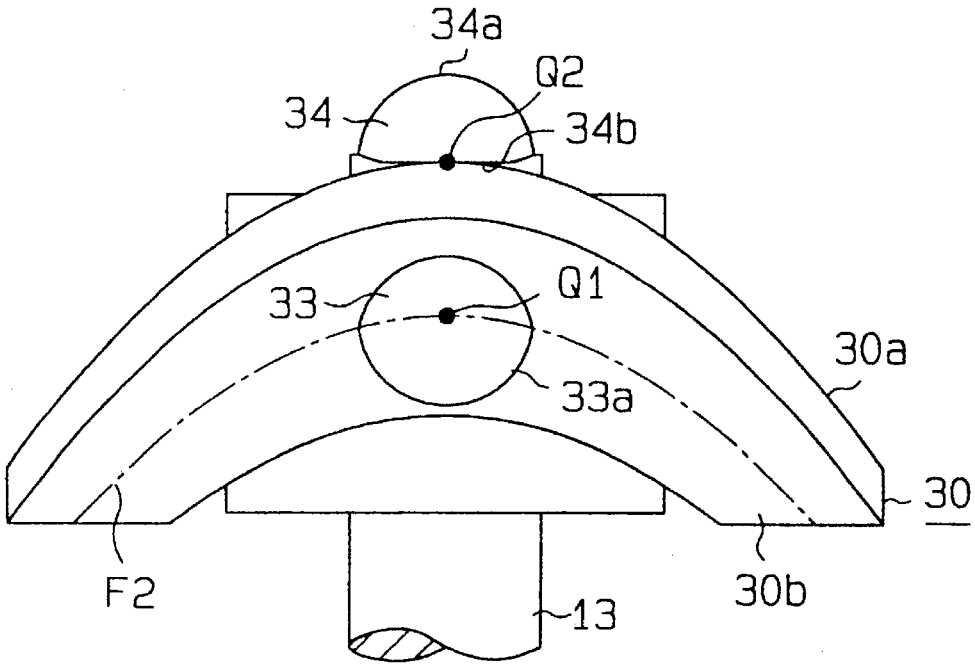
FIG. 7 also shows a plan view of the wave cam consisting of predetermined cylindrical surfaces.
Figure 8:
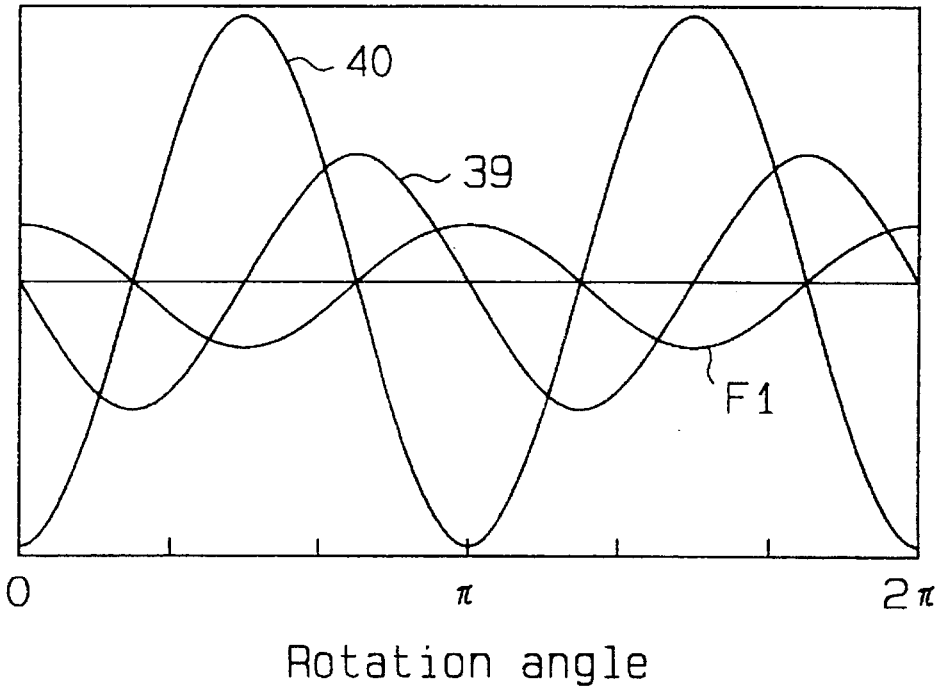
FIG. 8 is a graph showing cyclic displacement, speed distribution, and acceleration distribution with respect to the rotation angle of the wave cam.

The series of actions including suction, compression and discharge of the refrigerant gas in this type of compressor is performed twice per rotation of the rotational axis of the wave cam 30. As shown in FIGS. 6 and 7, the shoes 33,34, which convert the rotation of the wave cam 30 into reciprocating motion of the piston 16, rotate relative to the cam surfaces 30*a*,30*b* of the wave cam 30 such that the flat surfaces 33*b*, 34*b* may constantly be brought into line contact with the cam surfaces 30*a*,30*b*, respectively. FIG. 7 shows a state where the wave cam 30 of FIG. 6 is turned by 90°. In this turning, the centers Q1,Q2 of the spherical surfaces 33*a*,33*a* of the shoes 33,34 undergo cyclic displacement in accordance with the cam profiles as shown in FIG. 8. The curve F2 is shifted by π/2 from the phase of the displacement curve F1 of FIG. 8. Accordingly, a constant distance is maintained between the displacement curve F1 and the displacement curve F2 in the direction of z-axis (namely, in the axial direction of the drive shaft 3).

Figure 9:
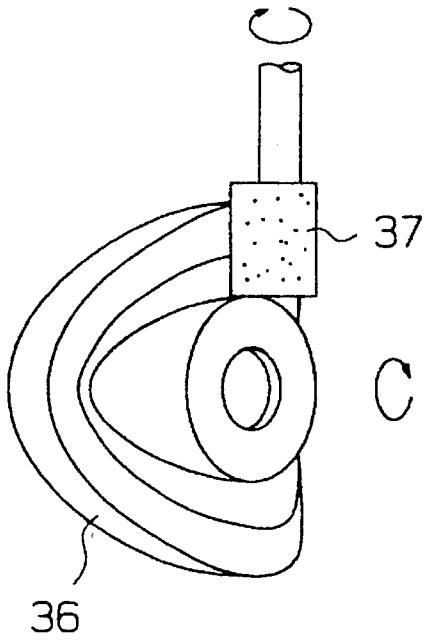
Fig. 9 (Prior Art)
FIG. 9 shows a plan view of a prior art wave cam being polished with a grindstone.

In the case of the prior art wave cam 36, shown in FIG. 9, employing solid curved surfaces, since the wavy cam surfaces must properly be subjected to grinding and polishing steps, the drive shaft of the end mill or grindstone 37 should be disposed parallel to the cam surface. Accordingly, the drive shaft of the end mill or grindstone 37 undergoes a reactive force exerted in the direction orthogonal to the drive shaft. Consequently, the drive shaft of the end mill or grindstone 37 may be deflected by the reactive force, tending to make the contact between the end mill or grindstone 37 and the cam surface unstable.

Figure 10:
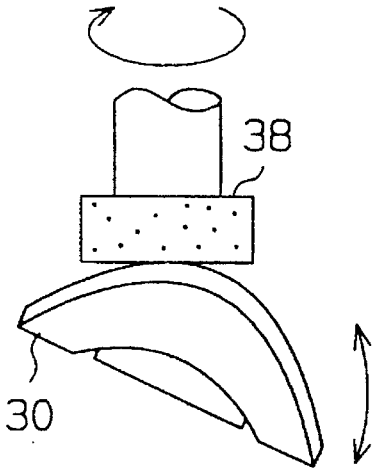
FIG. 10 shows a plan view of a wave cam being polished with a grindstone.

However, in the wave cam 30 according to this embodiment, as shown in FIG. 10, since the cam surfaces are composed of convex surfaces only, the drive shaft of the end mill or grindstone 38 can be oriented perpendicular to the cam surface. Thus, in the grinding and polishing steps, the reactive force from the cam surface to the end mill or grindstone 38 acts in the direction of the axis of the drive shaft. Accordingly, the drive shaft of the end mill or grindstone 38 can stably receive the reactive force, which enables stable surface machining.

Figure 11:
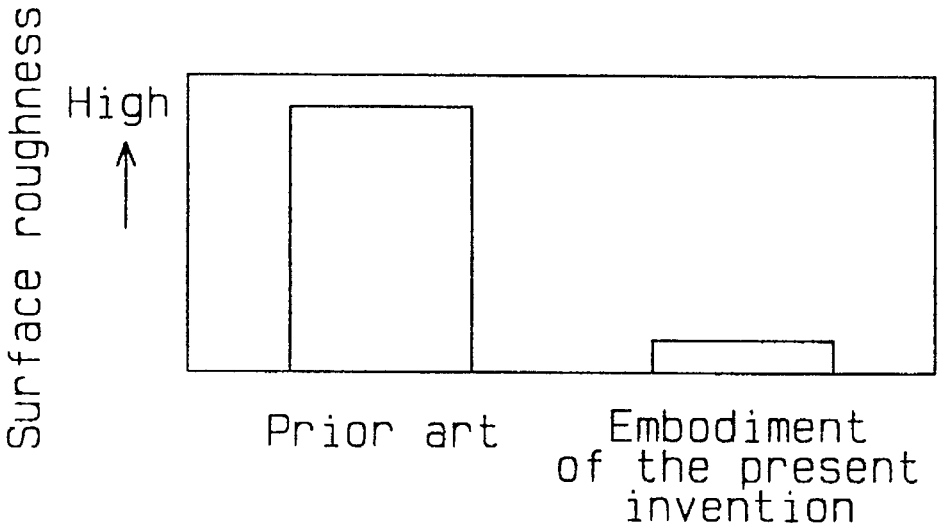
FIG. 11 is a graph comparing the surface roughness of the wave cam according to the first embodiment of the invention and that of the prior art wave cam.

FIG. 11 is a graph showing the result of comparison between the surface roughness of the prior art wave cam 36 and that of the wave cam 30 of this embodiment. As the graph clearly shows, the wave cam 30 of this embodiment composed of convex surfaces only can be subjected to surface machining at high accuracy compared with the prior art wave cam 36.

As has been detailed above, since the wave cam type compressor according to this embodiment employs a parabolic cylindroid 35, the cam surfaces 30*a*,30*b* consist of convex surfaces only. Accordingly, when the wave cam 30 is subjected to surface treatment, there is no need of using a grindstone 38 having a special shape, and the cam surfaces 30*a*,30*b* can be polished at a constant shape accuracy. In the wave cam 30 according to this embodiment, unlike the prior art wave cam 36 having complicated wavy surfaces, variation in the machining resistance can be minimized, thus facilitating high accuracy surface machining. Further, by allowing the wave cam 30 to have a smooth cam profile, the speed curve 39 and the acceleration curve 40 in the reciprocating motion of the piston 16 to be caused by displacement of the cam 30 can be made smooth with no disconnection, as shown in FIG. 8. Consequently, a series of actions associated with suction, compression, and exhaust are achieved smoothly.

Next, a second embodiment of the present invention will be described. In the second embodiment, the predetermined cylindrical surface constituting the wave cam and the shape of the shoes for converting the cyclic displacement of the cam into a reciprocating motion of the double-headed piston are different from those of the first embodiment. The same constituents as in the first embodiment are given the same reference numbers, description thereof will be omitted and only the differences will mainly be described. Further, description of the actions and effects that are similar to the first embodiment will also be omitted.

Figure 12:
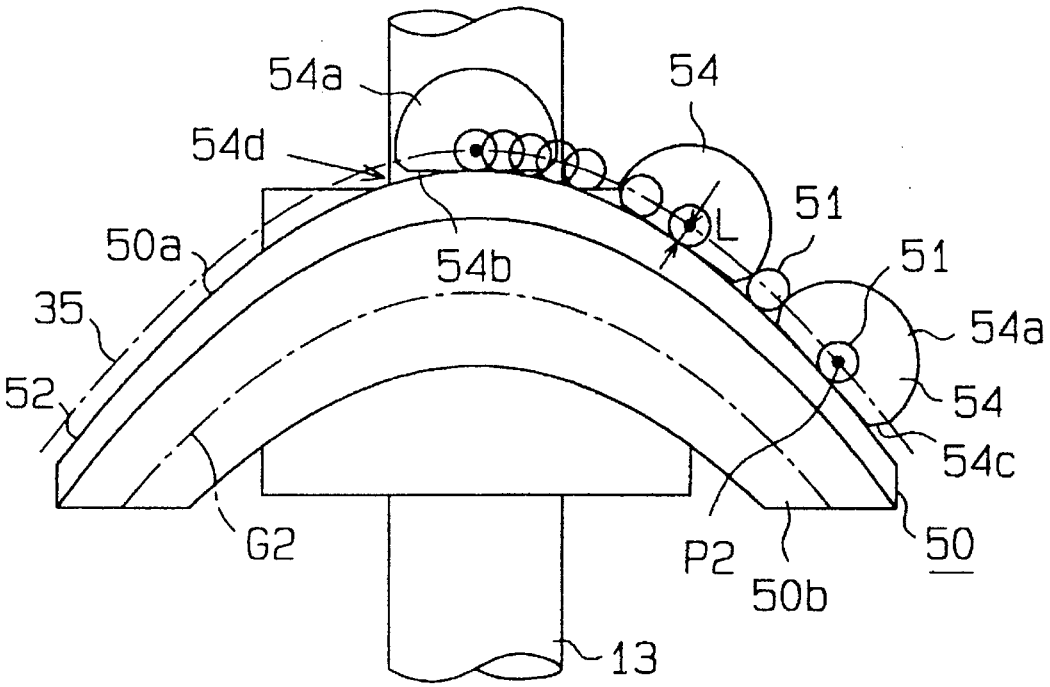
FIG. 12 shows in plan view a wave cam according to a second embodiment of the present invention.

As shown in FIG. 12, the cam surfaces 50*a*,50*b* are composed of curved surfaces which can be obtained by cutting, along a cylindroid, the surface of a parabolic cylindroid 35 generated by a parabola represented by the equation (6). Each of the curved surfaces consists of a cam surface 52 defined by a rolling surface of plurality of imaginary balls 51 having a radius L. That is, the distance from the center of each ball to the curved surface is equal to L. The wave cam 50 can be formed by combining two of such surfaces 52 back to back with a phase difference of 90° therebetween. These cam surfaces 50*a*,50*b* are contracted by a predetermined distance L in the axial direction with respect to the parabolic cylindroid 35. Therefore, as in the first embodiment, the first and second conditions are satisfied.

Figure 13:
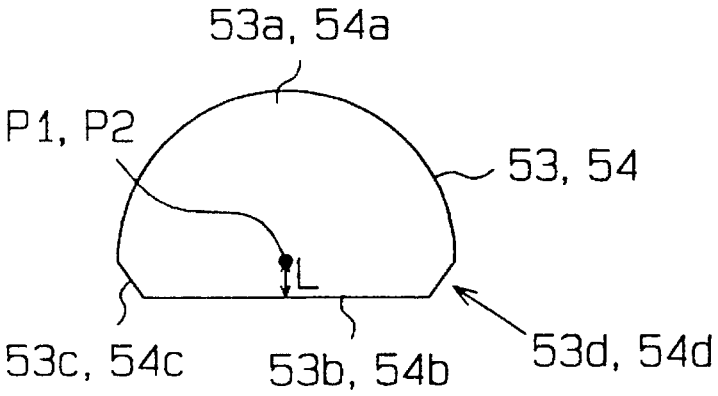
FIG. 13 shows a plan view of a shoe.

Shoes 53,54 shown in FIG. 13 are interposed between the wave cam 50 and each piston 16. The shoes 53,54 have spherical surfaces 53*a*,54*a*, flat surfaces 53*b*,54*b* and reducing surfaces 53*c*,54*c*. The spherical surfaces 53*a*,54*a* are fitted in the recesses 16*a*,16*b* of each piston 16; the flat surfaces 53*b*,54*b* slide on the cam surfaces 50*a*,50*b* of the wave cam 50; and the reducing surfaces 53*c*,54*c* connect the spherical surfaces 53*a*,54*a* and the flat surfaces 53*b*,54*b*, respectively. The flat surfaces 53*b*,54*b* and the reducing surfaces 53*c*,54*c* constitute sliding sections 53*d*,54*d*, respectively. The reducing surfaces 53*c*,54*c* are beveled with respect to the flat surfaces 53*a*, 54*b*. The centers P1,P2 of the spherical surfaces 53*a*,54*a* of the shoes 53,54 are set at the interface between the spherical surfaces 53*a*,54*a* and the sliding sections 53*d*,54*d*. The thickness (offset value) of the sliding sections 53*d*,54*d* is determined such that the centers P1,P2 are located at the predetermined distance L from the cam surfaces 50*a*,50*b* of the wave cam 50.

The series of suction, compression and exhaust is repeated twice per rotation of the wave cam 50 having displacement curves G1,G2 (only G2 is shown). The shoes 53,54 for converting the rotation of the wave cam 50 into a reciprocating motion of the piston 16 rotate relative to the cam surfaces 50*a*,50*b* of the wave cam 50 in such a way that the flat surfaces 53*b*,54*b* maintain line contact with the cam surface 50*a*,50*b*. In such relative rotation of the flat surfaces 53*b*, 54*b*, the sliding sections 53*d*,54*d*, having reducing surfaces 53*c*,54*c*, lead lubricant between each shoe 53,54 and the cam surfaces 50*a*,50*b* due to the effect of the beveled surfaces. This action forms appropriate oil films between the flat surfaces 53*b*,54*b* of the shoes 53,54 and the cam surfaces 50*a*,50*b* of the wave cam 50, respectively. Thus, the frictional resistance between the flat surfaces 53*b*,54*b* of the shoes 53,54 and the cam surfaces 50*a*,50*b* of the wave cam 50 is minimized.

As has been described above, the reducing surfaces 53*c*, 54*c* formed between the spherical surfaces 53*a*,54*a* of the shoes 53,54 and the flat surfaces 53*b*,54*b* thereof, facilitate lubrication between the flat surfaces 53*b*,54*b* of the shoes 53,54 and the cam surfaces 50*a*,50*b* of the cam 50. Accordingly, suction, compression and exhaust can stably be performed with smooth reciprocating motion of the piston 16. Further, since the piston 16 can be allowed to reciprocate smoothly in the cylinder bores 11*a*,12*a*, power loss and noise are reduced.

Although only two embodiments of the present invention have been described herein, it should be apparent to those skilled in the art that the present invention may be embodied in many other specific forms without departing from the spirit or scope of the invention. Particularly, it should be understood that the present invention may be embodied in the following modes.

While the cam surfaces 30*a*,30*b*,50*a*,50*b* of the wave cams 30,50 are composed of convex surfaces only in the embodiments described above, the portions of the cam surfaces 30*a*,30*b*,50*a*,50*b* which are not brought into contact with the sliding surfaces of the shoes 33,34,53,54 may have concave surfaces or flat surfaces.

While an imaginary parabolic cylindroid 35 to be obtained using a predetermined parabola as the director curve is employed on the cam surfaces 30*a*,30*b*,50*a*,50*b* in the embodiments described above, the director curve is not critical so long as it is a curve having an axis of symmetry on the coordinate z. In short, any convex curve can be employed.

Figure 14:
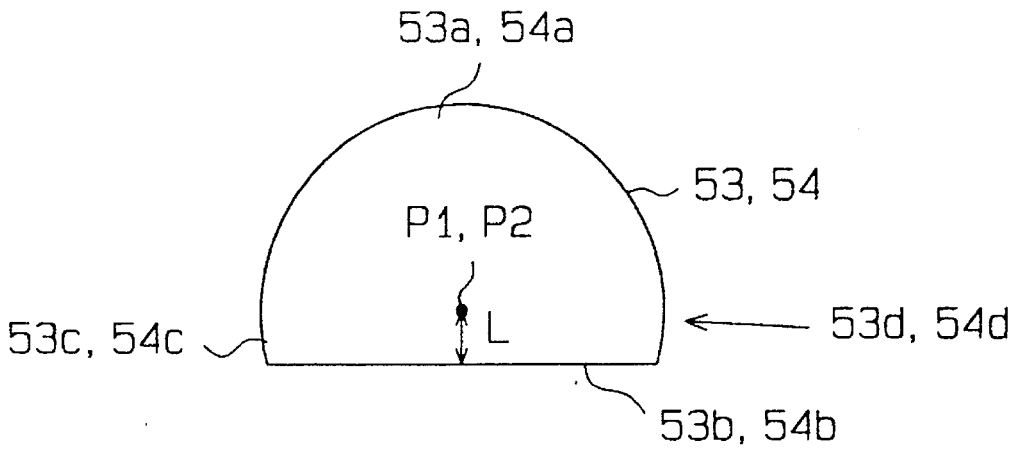
FIG. 14 shows a plan view of a shoe according to another embodiment of the present invention.
Figure 15:
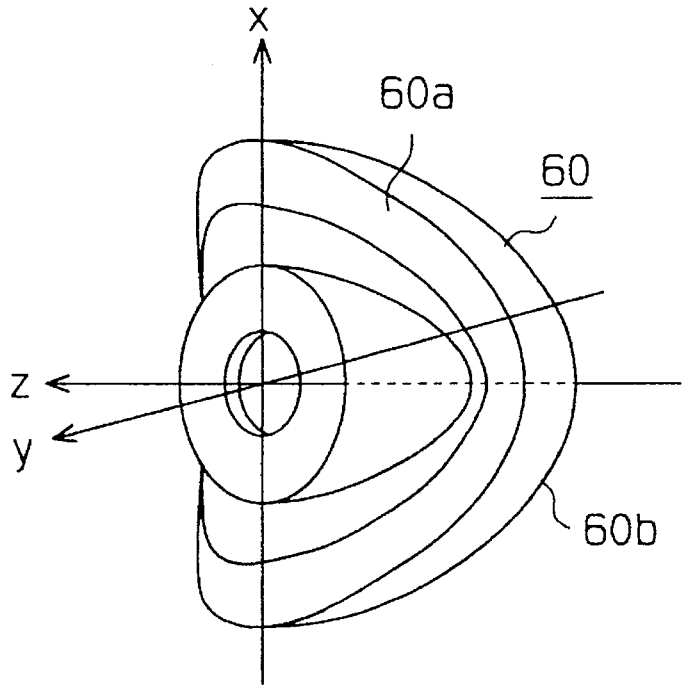
Fig. 15 (Prior Art)
FIG. 15 shows a perspective view of a prior art wave cam.

While the shoes 53,54 having offsets employed in the second embodiment have beveled sliding sections 53*d*,54*d* so as to facilitate lubrication of the sliding sections, the reducing surfaces 53*c*,54*c* may be formed by partly changing the curvature of the spherical surfaces 35*a*,54*a*, as shown in FIG. 14.

While the flat surfaces 33*b*,34*b*,53*b*,54*b* are flat in in the above embodiments, they may have recesses as oil wells.

Therefore, the present examples and embodiments are to be considered as illustrative and not restrictive, and the invention is not to be limited to the details given herein, but may be modified within the scope of the appended claims.

What is claimed is:

1. A wave cam type compressor having a wave cam body mounted on a drive shaft for integral rotation with the drive shaft, and a piston disposed within a cylinder bore and operably connected to the cam body, whereby rotation of the drive shaft is converted into reciprocating movement of the piston with a predetermined piston stroke between a top dead center and a bottom dead center in said cylinder bore to compress fluid supplied to the cylinder bore, said compressor comprising:

a cam surface on said cam body for driving the piston;

a shoe interposed between the cam surface and the piston, said shoe being arranged to follow a predetermined path on the cam surface; and said cam surface being cylindrical and continuously convex with its elements in end projection defining a plane curve such that said predetermined path is free from points of inflection.

2. The compressor as set forth in claim 1, wherein said cam surface includes a first portion and a second portion respectively associated with the top dead center and the bottom dead center of the piston stroke.

3. The compressor as set forth in claim 2, wherein said shoe has a flat surface for slidably contacting the cam surface and a spherical surface for slidably engaging to the piston.

4. The compressor as set forth in claim 3, wherein said cam surface includes a part of a surface of an imaginary parabolic cylindroid, said imaginary parabolic cylindroid being defined by a non-finite directrix in the form of a predetermined parabolic curve.

5. The compressor as set forth in claim 4, wherein said cam surface has an envelope surface everywhere spaced equidistantly radially inward from an imaginary parabolic cylindrical surface; and said spherical surface of the shoe has a center of curvature spaced from the flat surface of the shoe by an amount equal to said equidistant inward spacing of said envelope surface.

6. The compressor as set forth in claim 3, wherein said spherical surface has a center 2 curvature on the flat surface.

7. The compressor as set forth in claim 3 wherein said shoe further includes a reducing surface continuous to the spherical surface and the flat surface, said reducing surface forming an obtuse angle with the flat surface.

8. The compressor as set forth in claim 1, wherein said cam surface includes:

a pair of first portions, each of said first portions having a peak associated with the top dead center of the piston stroke, said first portions being angularly spaced one from another by 180°;

a pair of second portions, each of said second portions having a lowest point associated with the bottom dead center of the piston stroke, said second portions being angularly spaced one from another by 180°; and said first portions and said second portions are angularly spaced one from another by 90°.

9. A wave cam type compressor having a wave cam body mounted on a drive shaft for integral rotation with the drive shaft, a plurality of cylinder bores disposed in a circular manner about the drive shaft, and a plurality of double head type pistons disposed one in each of the cylinder bores and operably connected to the cam body, whereby rotation of the drive shaft is converted into reciprocating movement of each piston, whereby a piston head of each piston moves with a predetermined piston stroke between a top dead center and a bottom dead center in the associated cylinder bore to compress fluid supplied to the cylinder bore, said compressor comprising:

a pair of cam surfaces on said cam body, each of which has a profile matching a predetermined curve, each cam surface being a continuously convex surface matching a part of an imaginary cylindroid, wherein each of said cam surfaces drives the pistons;

a plurality of shoes, each of said shoes being interposed between one of said cam surfaces and an associated piston, said shoes being arranged to follow a predetermined path on the associated cam surface.

10. The compressor as set forth in claim 9, wherein each of said cam surfaces includes:

a first portion having a peak associated with the top dead center of a piston stroke; and a second portion having a lowest point associated with the bottom dead center of a piston stroke.

11. The compressor as set forth in claim 10, wherein each of said shoes has a flat surface for slidably contacting the associated cam surface and a spherical surface for slidably engaging the associated piston.

12. The compressor as set forth in claim 11, wherein said cam surfaces each includes a part of a surface of an imaginary parabolic cylindroid, said imaginary parabolic cylindroid being defined by a non-finite directrix in the form of a predetermined parabolic curve.

13. The compressor as set forth in claim 12, wherein said cam surfaces each has an envelope surface everywhere spaced equidistantly radially inward from an imaginary parabolic cylindrical surface; and said spherical surface of each shoe has a center of curvature spaced from the flat surface of the shoe by an amount equal to said equidistant inward spacing of said envelope surface.

14. The compressor as set forth in claim 11, wherein each of said spherical surfaces has a center of curvature on the associated flat surface.

15. The compressor as set forth in claim 11, wherein each of said shoes further includes a reducing surface contiguous to the associated spherical surface and the associated flat surface, said reducing surface forming an obtuse angle with the associated flat surface.

16. The compressor as set forth in claim 9, wherein each of said cam surfaces includes:

a pair of first portions, each of said first portions having a peak associated with the top dead center of the piston stroke, wherein said first portions are angularly spaced one from another by 180°; angularly spaced one from another by 180°; and said first portions and said second portions are angularly spaced one from another by 90°.

17. A wave cam type compressor having a wave cam body mounted on a drive shaft for integral rotation with the drive shaft, a plurality of cylinder bores disposed in a circular manner about the drive shaft and a plurality of double head type pistons disposed one in each of the cylinder bores and operably connected to the cam body, whereby rotation of the drive shaft is converted into reciprocating movement of each piston, whereby a piston head of each piston moves with a predetermined piston stroke between a top dead center and a bottom dead center in the associated cylinder bore to compress fluid supplied to the cylinder bore, said compressor comprising:

a pair of cam surfaces on said cam body, each of which has a profile which matches a predetermined curve and has a convex surface matching a part of an imaginary cylindroid, wherein each of said cam surfaces drives the pistons;

each of said cam surfaces including a pair of first 180°, and a pair of second portions, each of said second portions having a lowest point associated with the bottom dead center of the piston stroke, wherein said second portions are angularly spaced one from another by 180°, and wherein said first portions and said second portions are angularly spaced one from another by 90°;

a plurality of shoes, each of said shoes being interposed between one of said cam surfaces and an associated piston, said shoes being arranged to follow a predetermined path on the associated cam surface, each of said shoes having a flat surface for slidably contacting the associated cam surface and having a spherical surface for slidably engaging the associated piston, each of said spherical surfaces having a center of curvature on the associated flat surface.

18. A wave cam type compressor having a wave cam body mounted on a drive shaft for integral rotation with the drive shaft, a plurality of cylinder bores disposed in a circular manner about the drive shaft and a plurality of double head type pistons disposed one in each of the cylinder bores and operably connected to the cam body, whereby rotation of the drive shaft is converted into reciprocating movement of each piston, whereby a piston head of each piston moves with a predetermined piston stroke between a top dead center and a bottom dead center in the associated cylinder bore to compress fluid supplied to the cylinder bore, said compressor comprising:

a pair of cam surfaces on said cam body, each of which has a profile which matches each of said cam surfaces including a pair of first portions, each of said first portions having a peak associated with the top dead center of the piston stroke, wherein said first portions are angularly spaced one from another by 180°, and a pair of second portions, each of said second portions having a lowest point associated with the bottom dead center of the piston stroke, wherein said second portions are angularly spaced one from another by 180°, and wherein said first portions and said second portions are angularly spaced one from another by 90°;

said cam surfaces each including an envelope surface everywhere spaced equidistantly radially inward from an imaginary parabolic cylindrical surface; and a plurality of shoes, each of said shoes being interposed between one of said cam surfaces and an associated piston, each of said shoes having a flat surface for slidably contacting the associated cam surface, a spherical surface for slidably engaging the associated piston, and a reducing surface contiguous to the associated spherical surface and the associated flat surface, said reducing surface forming an obtuse angle with the associated flat surface, whereby said spherical surface of each shoe has a center of curvature separated from the associated flat surface by a distance substantially equal to said equidistant inward spacing of said envelope surface.

* * * * *

UNITED STATES PATENT AND TRADEMARK OFFICE

CERTIFICATE OF CORRECTION

PATENT NO. : 5,601,416

DATED : February 11, 1997

INVENTOR(S) : Murakami et al.

It is certified that error appears in the above-indentified patent and that said Letters Patent is hereby corrected as shown below:

Column 4, line 34, change "cylindrical surface CO" to --circular path CO--; line 42, change "P1," to --F1,--.

Column 9, line 35, after "engaging" delete "to"; line 50, after " center" delete "2" and insert --of--; line 52, change "continuous" to --contiguous--.

Column 10, at line 60, insert:
-- a pair of second portions, each of said second portions having a lowest point associated with the bottom dead center of the piston stroke, wherein said second portions are angularly spaced one from another by 180°; and--.

Column 11, line 12, delete "180°," and insert --portions, each of said first portions having a peak associated with the top dead center of the piston stroke, wherein said first portions are angularly spaced one from another by 180°,--.

Column 12, at line 7, insert --a predetermined curve and has a convex surface matching a part of an imaginary cylindroid, wherein each of said cam surfaces drives the pistons--.

Signed and Sealed this

Second Day of December, 1997

*Attest:*

Bruce Lehman

BRUCE LEHMAN

*Attesting Officer*

*Commissioner of Patents and Trademarks*